US007381364B2

(12) United States Patent
Yamashita

(10) Patent No.: US 7,381,364 B2
(45) Date of Patent: Jun. 3, 2008

(54) GAS JET COOLING DEVICE

(75) Inventor: Keiichi Yamashita, Kakogawa (JP)

(73) Assignee: Kobe Steel, Ltd, Kobe-shi (JP)

( * ) Notice: Subject to any disclaimer, the term of this patent is extended or adjusted under 35 U.S.C. 154(b) by 286 days.

(21) Appl. No.: 11/124,293

(22) Filed: May 9, 2005

(65) Prior Publication Data

US 2005/0262723 A1 Dec. 1, 2005

(30) Foreign Application Priority Data

May 31, 2004 (JP) ..... 2004-161400

(51) Int. Cl.
*F26B 7/00* (2006.01)

(52) U.S. Cl. ..... 266/113; 266/111

(58) Field of Classification Search ..... 266/111, 266/113

See application file for complete search history.

(56) References Cited

U.S. PATENT DOCUMENTS 4,625,431 A * 12/1986 Nanba et al. ..... 266/111
4,704,167 A 11/1987 Ichida et al.
6,309,483 B1 10/2001 Wang et al.

FOREIGN PATENT DOCUMENTS

EP 0 803 583 A2 10/1997
EP 1 375 685 A1 1/2004
JP 62-116724 5/1987

* cited by examiner

*Primary Examiner*—Scott Kastler
(74) *Attorney, Agent, or Firm*—Oblon, Spivak, McClelland, Maier & Neustadt, P.C.

(57) ABSTRACT

A gas jet cooling device in a continuous annealing furnace is equipped with: windboxes disposed in a cooling chamber on both sides of a steel strip, blowing a cooling gas toward the strip through nozzles to cool it; and a means of cooling the gas introduced from the cooling chamber and then supplying the cooled gas to the windboxes, wherein the distance between the tips of the nozzles and the strip is not more than ten times the diameter of the nozzles; and the length of each of the windboxes in the strip traveling direction is not more than two thirds of the width of the strip. The gas jet cooling device can cool the strip rapidly and uniformly even when the distance between the strip and the front face of each windbox is shorter and the size of a cooling chamber is smaller than the conventional ones.

12 Claims, 13 Drawing Sheets

GAS JET COOLING DEVICE

BACKGROUND OF THE INVENTION

1. Field of the Invention

The present invention belongs to the technological field relating to a gas jet cooling device, especially to a gas jet cooling device for a steel strip in a continuous annealing furnace.

2. Description of the Related Art

JP-A No. 116724/1987 describes a gas jet cooling device for a steel strip in a continuous annealing furnace. The gas jet cooling device for a steel strip in a continuous annealing furnace described in the document is, with the aim of preventing the flow rate of a gas blown onto a steel strip from attenuating, configured so that: the distance a between the steel strip and the tips of nozzles may not be more than 70 mm and the length b of the nozzles protruding from the front face of a windbox may not be less than (100−a) mm; thereby the gas after blown onto the steel strip may be discharged into the free space in the furnace (the space excluding the space between the steel strip and the tip faces of the nozzles in the furnace); and resultantly the gas after blown onto the steel strip may less disturb the flow of the gas blown through other nozzles. Note that, the windbox is described under the term "cooling gas chamber" in the document.

Since the gas jet cooling device for a steel strip in a continuous annealing furnace described in JP-A No. 116724/1987 is configured so that the distance a between the steel strip and the tips of nozzles may not be more than 70 mm and the length b of the nozzles protruding from the front face of a windbox may not be less than (100−a) mm as stated above, the distance between the steel strip and the front face of a windbox is not less than 100 mm, thus the distance between opposing windboxes interposing the steel strip in between is not less than 200 mm, and the cooling chamber must be large accordingly. Note that, the cooling chamber is described under the term "furnace chamber" in the document.

When the size of a cooling chamber increases, the mass of an insulator per unit cooling length of the cooling chamber also increases, thus the thermal capacity thereof increases, and thereby the responsiveness (the thermal inertia) of the temperature in the cooling chamber lowers. As a result, when the steel strips the intended mechanical properties of which are different from each other are continuously processed and thus the cooling conditions are different between the preceding steel strip and the succeeding steel strip, the controllability of the intended cooling end temperature of each steel strip lowers and moreover the mechanical properties of each product can hardly be secured. Further, another arising problem is that it causes the construction cost of a cooling chamber to increase.

SUMMARY OF THE INVENTION

The present invention has been established in view of the above situation, and the object thereof is to provide: a gas jet cooling device for a steel strip in a continuous annealing furnace that improves the aforementioned problems of the prior art and is capable of cooling the steel strip rapidly and uniformly even when the distance between the steel strip and the front face of a windbox is short and the size of a cooling chamber is small; in other words, a gas jet cooling device for a steel strip in a continuous annealing furnace that secures the capability of the rapid and uniform cooling of the steel strip and, on top of that, is capable of shortening the distance between the steel strip and the front face of a windbox and thus reducing the size of a cooling chamber.

The present inventors have earnestly studied to attain the aforementioned object and have resultantly established the present invention. The present invention makes it possible to attain the aforementioned object.

The present invention that has herewith been established and has attained the aforementioned object relates to a gas jet cooling device which is configured as follows:

The gas jet cooling device according to the first invention, comprising: a cooling chamber; windboxes being disposed in said cooling chamber on both the sides of a metal strip to be cooled in a manner of interposing the metal strip in between, said windboxes blowing a cooling gas toward the metal strip to be cooled through nozzles so as to cool the metal strip; and means for cooling gas introduced from said cooling chamber and then supplying the cooled gas to said windboxes as the cooling gas, wherein the distance (h) between the tips of the nozzles on each of said windboxes and the metal strip to be cooled is not more than ten times the diameter (d) of said nozzles, and the length (L) of each of said windboxes in the traveling direction of the metal strip to be cooled is not more than two thirds of the width (W) of the metal strip to be cooled.

The gas jet cooling device according to the second invention is a gas jet cooling device according to the first invention, wherein the nozzles on each of the windboxes are composed of a group of round or polygonal holes; and the holes are allocated so as to form a lattice pattern or a staggered pattern.

The gas jet cooling device according to the third invention is a gas jet cooling device according to the first or second invention, wherein the number of the nozzle rows on each of the windboxes in the traveling direction of the metal strip to be cooled is not less than four, and the number of the nozzle rows thereon in the width direction of the metal strip to be cooled is not less than four.

The gas jet cooling device according to the fourth invention is a gas jet cooling device according to any one of the first to third invention, wherein the number of the windboxes in the traveling direction of the metal to be cooled is not less than two, and the ratio (z/h) of the gap (z) between two adjacent windboxes to the distance (h) between the tips of the nozzles of each of the windboxes and the metal strip to be cooled is in the range from 1.0 to 4.0.

The gas jet cooling device according to the fifth invention is a gas jet cooling device according to any one of the first to fourth invention, wherein the face, which is opposed to the metal strip to be cooled, of each of the windboxes is flat, and the distances (h) between the tips of the nozzles on each of the windboxes and the metal strip to be cooled stays constant in the width direction of the metal strip to be cooled but changes so as to increase from the upstream toward the downstream in the traveling direction of the metal strip to be cooled.

The gas jet cooling device according to the sixth invention is a gas jet cooling device according to any one of the first to fourth invention, wherein the face, which is opposed to the metal strip to be cooled, of each of the windboxes has a convex shape in the traveling direction of the metal strip to be cooled, and the face forms a curved face, a stepwise face comprising plural planes, or a face comprising two or more inclined planes in the traveling direction of the metal strip to be cooled.

The gas jet cooling device according to the seventh invention is a gas jet cooling device according to any one of the first to sixth invention, wherein the section of each of the windboxes, the section being parallel with the traveling direction of the metal strip to be cooled and perpendicular to the metal strip, has a rectangular shape, wherein the opening of each windbox to supply the cooling gas is disposed on at least one of the side face and the back face of the windbox at the upstream end or the downstream end of the windbox in the traveling direction of the metal strip to be cooled and the ratio (A/S) of the sectional area (A) of the rectangular shape to the total (S) of the areas of nozzle openings of the windbox is in the range from 1.0 to 3.0.

A gas jet cooling device according to the present invention makes it possible to cool a metal strip rapidly and uniformly even when the distance between the metal strip and the front face of a windbox is short and the size of a cooling chamber is small. In other words, it makes it possible to secure the capability of the rapid and uniform cooling of a metal strip, on top of that, to shorten the distance between the metal strip and the front face of a windbox, and thus to reduce the size of a cooling chamber.

BRIEF DESCRIPTION OF THE DRAWINGS

FIG. 5 comprises a group of schematic illustrations showing the flow of the gas (the gas flow) ejected from the circumference of each windbox.

DESCRIPTION OF THE PREFERRED EMBODIMENTS

Figure 1:
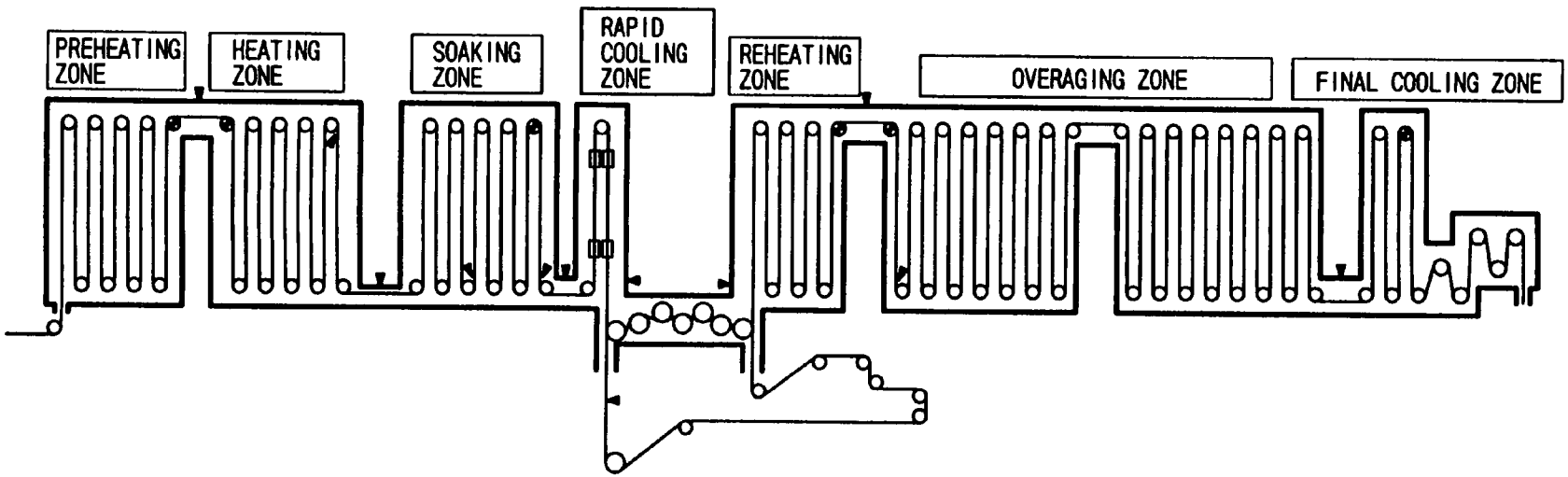
FIG. 1 is a schematic illustration showing an example of a continuous annealing furnace.

When a steel strip is cooled by a gas with a gas jet cooling device for a steel strip in a continuous annealing furnace (hereunder referred to as "a gas jet cooling device" occasionally), it is extremely important to cool the steel strip not only rapidly but also uniformly. As a gas jet cooling device (a gas jet cooling device for a steel strip in a continuous annealing furnace), generally used is a cooling device which is equipped with: windboxes that are disposed in a cooling chamber on both the sides of the steel strip in a manner of interposing the steel strip in between, blow a cooling gas toward the steel strip through nozzles, and thus cool the steel strip; and a means of cooling the gas introduced from the cooling chamber and then supplying the cooled gas to the windboxes as the cooling gas. When a steel strip is cooled by a gas with such a gas jet cooling device, in order to cool it rapidly, it is preferable to shorten the distance between the tips of nozzles on a windbox and the steel strip. However, when the front face of the windbox is merely brought closer to the steel strip in order to shorten the distance, it becomes difficult to cool the steel strip uniformly in the direction of the steel strip width.

The gas jet cooling device according to the present invention is, as stated above, a gas jet cooling device for a steel strip in a continuous annealing furnace, the cooling device being equipped with: windboxes that are disposed in a cooling chamber on both the sides of the steel strip in a manner of interposing the steel strip in between, blow a cooling gas toward the steel strip through nozzles, and thus cool the steel strip; and a means of cooling the gas introduced from the cooling chamber and then supplying the cooled gas to the windboxes as the cooling gas, characterized in that: the distance (h) between the tips of the nozzles on each of the windboxes and the steel strip is not more than ten times the diameter (d) of the nozzles; and the length (L) of each of the windboxes in the steel strip traveling direction is not more than two thirds of the width (W) of the steel strip.

Since, in this way, the distance (h) between the tips of the nozzles on each of the windboxes and the steel strip is not more than ten times the diameter (d) of the nozzles, the steel strip can thereby be cooled rapidly.

Further, since the length (L) of each of the windboxes in the steel strip traveling direction is not more than two thirds of the width (W) of the steel strip, it becomes possible thereby: to increase the part flowing toward the steel strip traveling direction of the cooling gas that has been ejected through nozzles; and to decrease the other part thereof flowing toward the steel strip width direction. As a result, it becomes possible to cool the steel strip uniformly in the steel strip width direction even when the front face of each of the windboxes is brought closer to the steel strip as stated above with the aim of shortening the distance h between the tips of the nozzles on each of the windboxes and the steel strip (satisfying the expression $h \leqq 10d$) from the viewpoint of securing the rapid cooling of the steel strip.

That is, when the front face of each of the windboxes is merely brought closer to the steel strip with the aim of shortening the distance between the tips of the nozzles on each of the windboxes and the steel strip from the viewpoint of securing the rapid cooling of the steel strip, it becomes difficult to cool the steel strip uniformly in the steel strip width direction. However, when the length (L) of each of the windboxes in the steel strip traveling direction is not more than two thirds of the width (W) of the steel strip, it becomes possible to cool the steel strip uniformly in the steel strip width direction even when the front face of each of the windboxes is brought closer to the steel strip. In the case of the aforementioned prior art (a gas jet cooling device disclosed in JP-A No. 116724/1987), as stated above, the cooling device is configured so that the nozzles are protruded and the free space (the space excluding the space between a steel strip and the tip faces of the nozzles in the furnace) is formed in the furnace. In contrast, in the case of a gas jet cooling device according to the present invention, neither the protrusion of the nozzles nor the formation of the free space by the protrusion of the nozzles in the furnace is required and a steel strip can be cooled uniformly in the steel strip width direction even when the length of the protruding nozzles is short or otherwise the nozzles do not protrude.

As a result, in the case of a gas jet cooling device according to the present invention, the length of the protruding nozzles can be shortened or otherwise the nozzles may not protrude, thus the distance between a steel strip and the front face of a windbox can be shortened, and resultantly the size of a cooling chamber can be reduced.

Consequently, a gas jet cooling device according to the present invention makes it possible to cool a steel strip rapidly and uniformly even when the distance between the steel strip and the front face of a windbox is short and the size of a cooling chamber is small. In other words, it makes it possible to secure the capability of the rapid and uniform cooling of a steel strip, on top of that, to shorten the distance between the steel strip and the front face of a windbox, and resultantly to reduce the size of a cooling chamber.

When the size of a cooling chamber can be reduced in this way, the mass of an insulator per unit cooling length of the cooling chamber decreases, thus the thermal capacity thereof decreases, and thereby the responsiveness (the thermal inertia) of the temperature in the cooling chamber improves. As a result, even when the steel strips the intended mechanical properties of which are different from each other are continuously processed and thus the cooling conditions are different between the preceding steel strip and the succeeding steel strip, the controllability of the intended cooling end temperature of each steel strip improves and moreover the mechanical properties of each product can easily be secured. Further, the construction cost of a cooling chamber can be reduced.

The reason why it is specified that the distance (h) between the tips of the nozzles on each of windboxes and a steel strip is not more than ten times the diameter (d) of the nozzles in a gas jet cooling device according to the present invention is that, if the distance h exceeds the value 10d, the cooling rate of the steel strip lowers and thus the rapid cooling of the steel strip is insufficient.

The reason why it is specified that the length (L) of each of windboxes in the steel strip traveling direction is not more than two thirds of the width (W) of a steel strip is that, if the length L exceeds $\frac{2}{3} \times W$, it becomes difficult to secure the capability of uniformly cooling the steel strip while securing the capability of rapidly cooling the steel strip. In other words, the reason is that, when the distance h between the tips of the nozzles on each of windboxes and a steel strip is kept so as not to be more than ten times of the nozzle diameter d as mentioned above in order to secure the rapid cooling of the steel strip, it becomes difficult to cool the steel strip uniformly in the steel strip width direction.

In a gas jet cooling device according to the present invention, the shape and allocation of the nozzles on each of windboxes are not particularly limited and various kinds can be adopted. For example, it may be configured so that: the nozzles on each of windboxes are composed of a group of round or polygonal holes; and the holes are allocated so as to form a lattice pattern or a staggered pattern (the second invention).

The number of the nozzles on each of windboxes is not particularly limited and may be selected variously. For example, it may be configured so that: the number of the nozzle rows in the steel strip traveling direction is not less than four; and the number of the nozzle rows in the steel strip width direction is also not less than four (the third invention). In the case of the windboxes exemplified here, forced convective heat transfer by multiple perforation jets can be secured reliably.

When it is configured so that: the number of windboxes in the steel strip traveling direction is not less than two; and the ratio (z/h) of the gap (z) between two adjacent windboxes to the distance (h) between the tips of the nozzles on each of the windboxes and a steel strip is in the range from 1.0 to 4.0, it becomes possible to cool the steel strip rapidly and uniformly in the steel strip width direction more reliably (the fourth invention). If the ratio z/h is less than 1.0, the reliability of cooling a steel strip uniformly in the steel strip width direction lowers and if the ratio z/h exceeds 4.0, the reliability of rapidly cooling a steel strip lowers. In contrast, when the ratio z/h is in the range from 1.0 to 4.0, it becomes possible to cool a steel strip rapidly and uniformly in the steel strip width direction more reliably.

Figure 12:
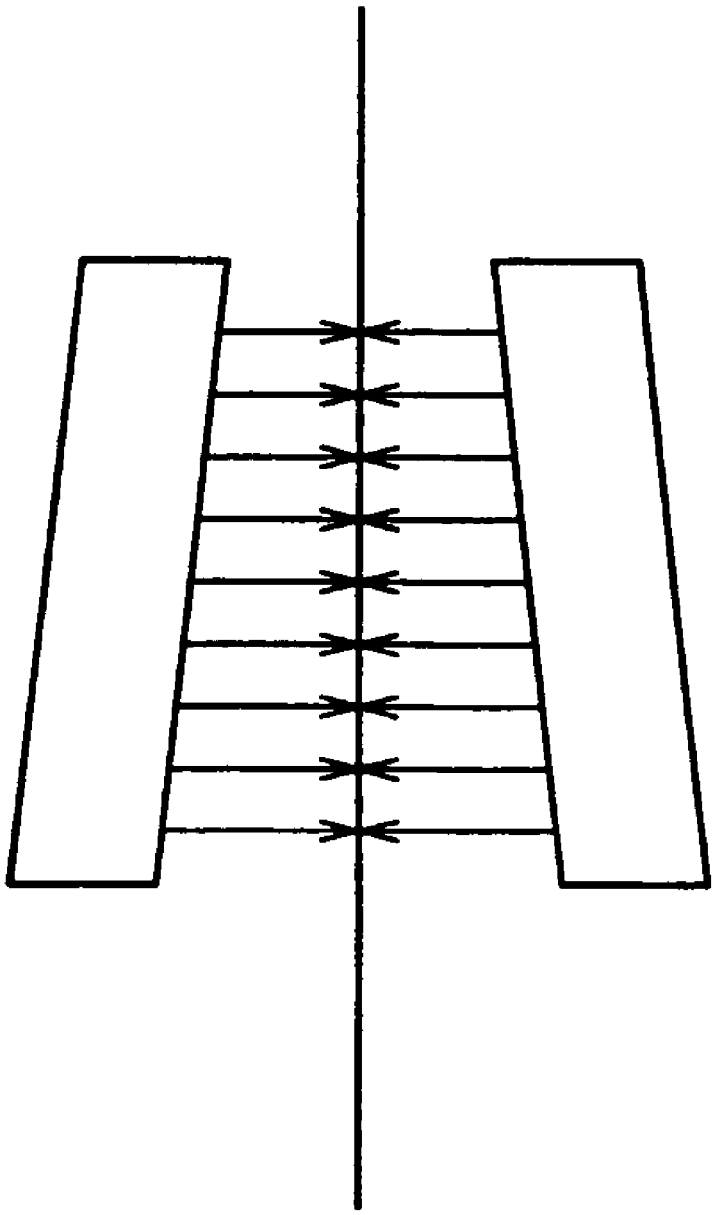
FIG. 12 is a schematic illustration showing an example of windboxes according to the fifth invention of the present invention.

When it is configured so that: the face, which is opposed to a steel strip, of each of windboxes is flat; and the distance (h) between the tips of the nozzles on each of the windboxes and the steel strip stays constant in the steel strip width direction but changes so as to increase from the upstream toward the downstream in the steel strip traveling direction, the gas that has been ejected from the nozzles and blown onto the steel strip becomes likely to flow toward the strip traveling direction. As a result, it becomes possible: to cool the steel strip uniformly in the steel strip width direction more reliably even when the front face of each of the windboxes is brought closer to the steel strip; or otherwise to bring the front face of each of the windboxes closer to the steel strip while securing the capability of cooling the steel strip rapidly and uniformly; and resultantly to reduce the size of a cooling chamber (the fifth invention). An example of such windboxes is shown in FIG. 12. Here, in FIG. 12, the center line between the front faces of the opposing windboxes shows a traveling steel strip and the allow lines between the steel strip and the front faces of the windboxes illustratively show the flows and directions of the cooling gas (the jet gas) blown onto the steel strip through the nozzles on each of the windboxes.

Figure 13:
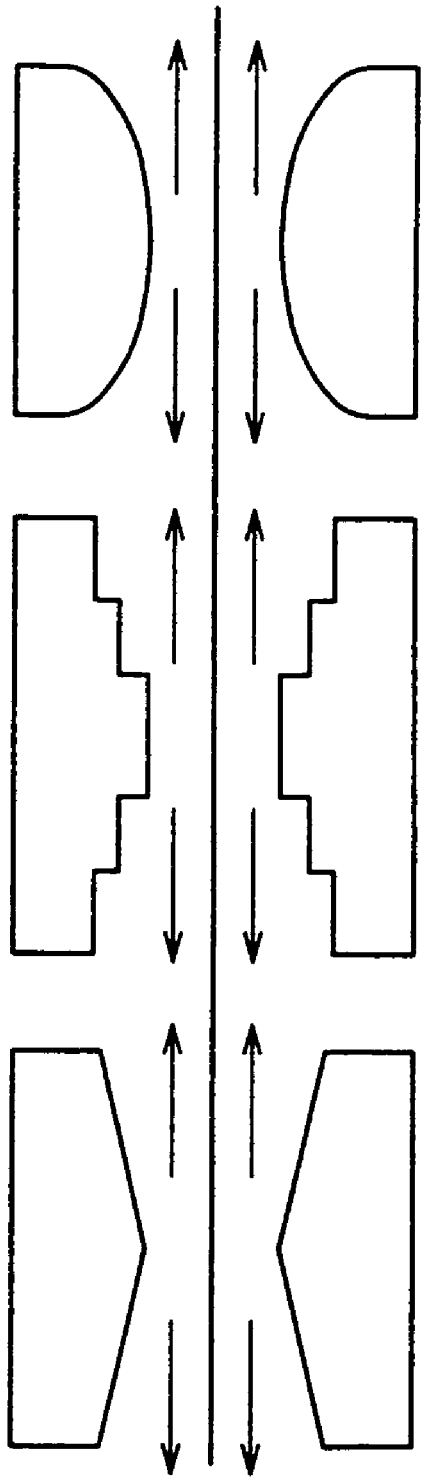
FIG. 13 comprises a group of schematic illustrations showing examples of windboxes according to the sixth invention of the present invention.

When it is configured so that: the face, which is opposed to a steel strip, of each of windboxes has a convex shape in the steel strip traveling direction; and the face forms a curved face, a stepwise face comprising plural planes, or a face comprising two or more inclined planes in the steel strip traveling direction, the gas that has been ejected from nozzles and blown onto the steel strip becomes likely to flow toward the steel strip traveling direction in the same way as above, and thereby the effects similar to the above case can be obtained (the sixth invention). Examples of such windboxes are shown in FIGS. 13(A), 13(B) and 13(C). Here, in FIG. 13, the center line between the front faces of the opposing windboxes shows a traveling steel strip and the allow lines between the steel strip and the front faces of the windboxes illustratively show the flows in the steel strip traveling direction and the directions of the gas after blown onto the steel strip.

When it is configured so that: the section of each of windboxes, the section being parallel with the steel strip traveling direction and perpendicular to a steel strip, has a rectangular shape; the opening of each windbox to supply a cooling gas is disposed on the side face and/or the back face of the windbox at the upstream end or the downstream end of the windbox in the steel strip traveling direction; and the ratio (A/S) of the sectional area (A) of the rectangular shape to the total (S) of the areas of nozzle openings of the windbox is in the range from 1.0 to 3.0, the pressure of a gas in each windbox is likely to be increased, and thus it becomes possible to reduce the cost incurred by the pressure up, to reduce the thickness of a cooling chamber, to improve the responsiveness of the temperature in the cooling chamber, to reduce the operating time to be spent until the cooling end temperature of a steel strip is stabilized when the steel strips the intended mechanical properties of which are different from each other are continuously processed and thus the cooling conditions are different between the preceding steel strip and the succeeding steel strip, thus to reduce the cost incurred by the operation, and resultantly to reduce the running cost incurred by the gas jet cooling of the steel strips (the seventh invention).

That is, when the rectangular sectional area (A) of each of windboxes is smaller than the total (S) of the areas of the nozzle openings of each windbox, the flow rate of a cooling gas flowing from the opening to supply the cooling gas to the nozzles in each windbox increases, the pressure loss increases, the pressure for supplying the gas increases, and thereby the running cost incurred by the gas pressure up in each windbox increases. In contrast, when the rectangular sectional area (A) of each windbox is larger than the total (S) of the areas of the nozzle openings of each windbox, the flow rate of a cooling gas flowing from the opening to supply the cooling gas to the nozzles in each windbox decreases, the pressure loss decreases, and the pressure for supplying the gas is reduced, and thereby the running cost incurred by the gas pressure up in each windbox can be reduced. However, the increase of the rectangular sectional area (A) of each windbox directly leads to the increase of the thickness of each windbox, and resultantly the thickness of a cooling chamber increases. As a result, the responsiveness of the temperature in the cooling chamber lowers and the operating time increases to be spent until the cooling end temperature of a steel strip is stabilized when the steel strips the intended mechanical properties of which are different from each other are continuously processed and thus the cooling conditions are different between the preceding steel strip and the succeeding steel strip.

When the ratio (A/S) of the rectangular sectional area (A) of each of windboxes to the total (S) of the areas of the nozzle openings of each windbox is in the range from 1.0 to 3.0, it becomes possible to reduce the running cost incurred by the increase of the gas pressure in each windbox, to reduce the thickness of a cooling chamber, to improve the responsiveness of the temperature in the cooling chamber, to reduce the operating time to be spent until the cooling end temperature of a steel strip is stabilized when the steel strips the intended mechanical properties of which are different from each other are continuously processed and thus the cooling conditions are different between the preceding steel strip and the succeeding steel strip, thus to reduce the cost incurred by the operation, and resultantly to reduce the running cost incurred by the gas jet cooling of the steel strips.

Figure 15:
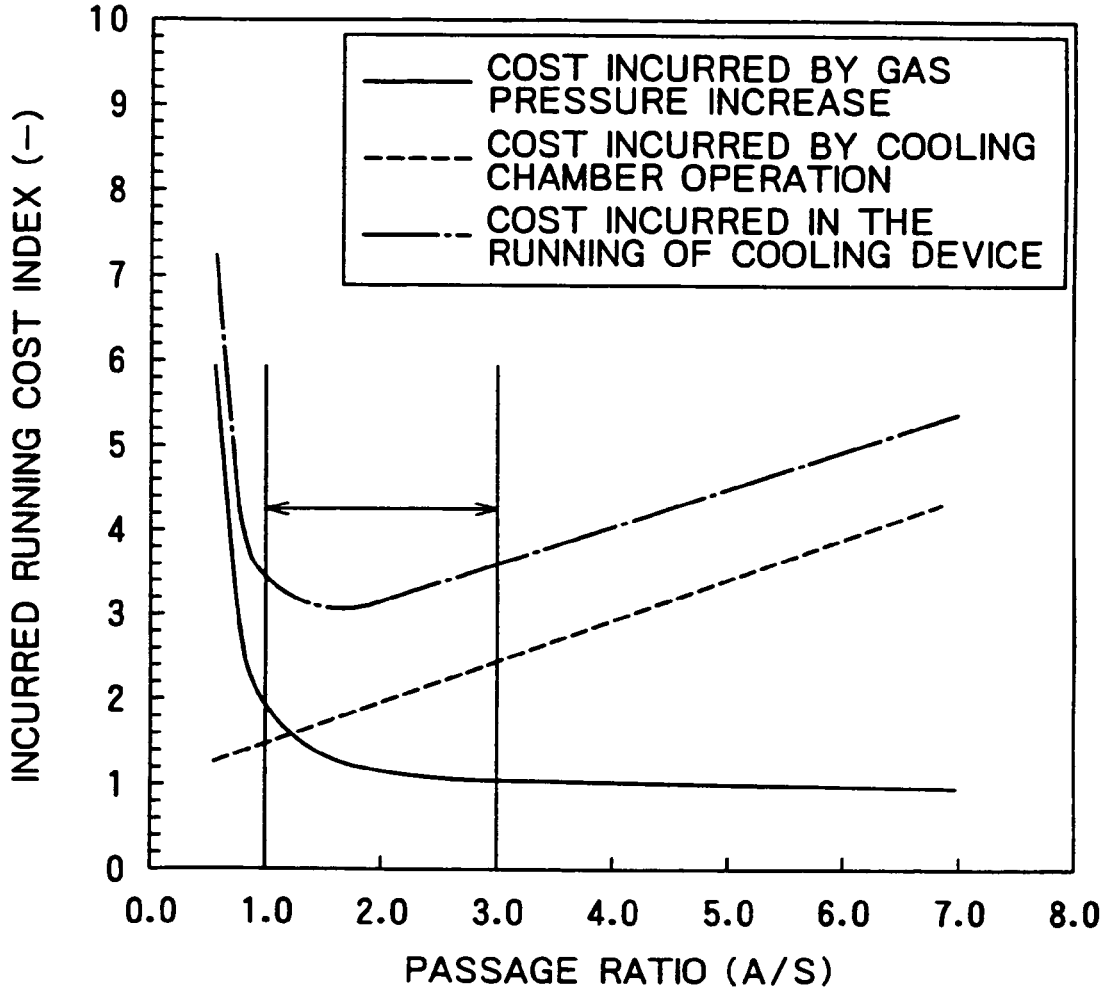
FIG. 15 is a graph showing the relationship between the passage ratio (A/S) and the incurred running cost index.

The above situation is hereunder explained with figures. FIG. 15 shows the relationship between the passage ratio, which is the ratio (A/S) of the rectangular sectional area A of a windbox to the total S of the areas of the nozzle openings of the windbox, and the incurred running cost index. Here, in FIG. 15, the cost incurred by gas pressure rise (solid line) is represented by a pressure rise running cost index (a relative value in the case where the pressure rise required at nozzles is regarded as one) and the running cost incurred by the cooling chamber operation (dotted line) is represented by a cooling chamber temperature unsteady time running cost index (a relative value in the case where the cost incurred in cooling chamber stabilization when the rectangular sectional area A of a windbox is zero is regarded as one). The cooling device incurred running cost (dot-dash line) is represented by the sum (the total value) of those two indexes (the pressure rise running cost index and the cooling chamber temperature unsteady time running cost index).

As it is understood from FIG. 15, there exists the shape of a windbox that can reduce the cooling device incurred running cost, namely the running cost incurred in the gas jet cooling of a steel strip, and it is desirable to control the ratio (A/S) of the rectangular sectional area A of a windbox to the total S of the areas of the nozzle openings of the windbox so as to be in the range from 1.0 to 3.0, and by so doing the running cost incurred in the gas jet cooling of the steel strip can be reduced.

Figure 14:
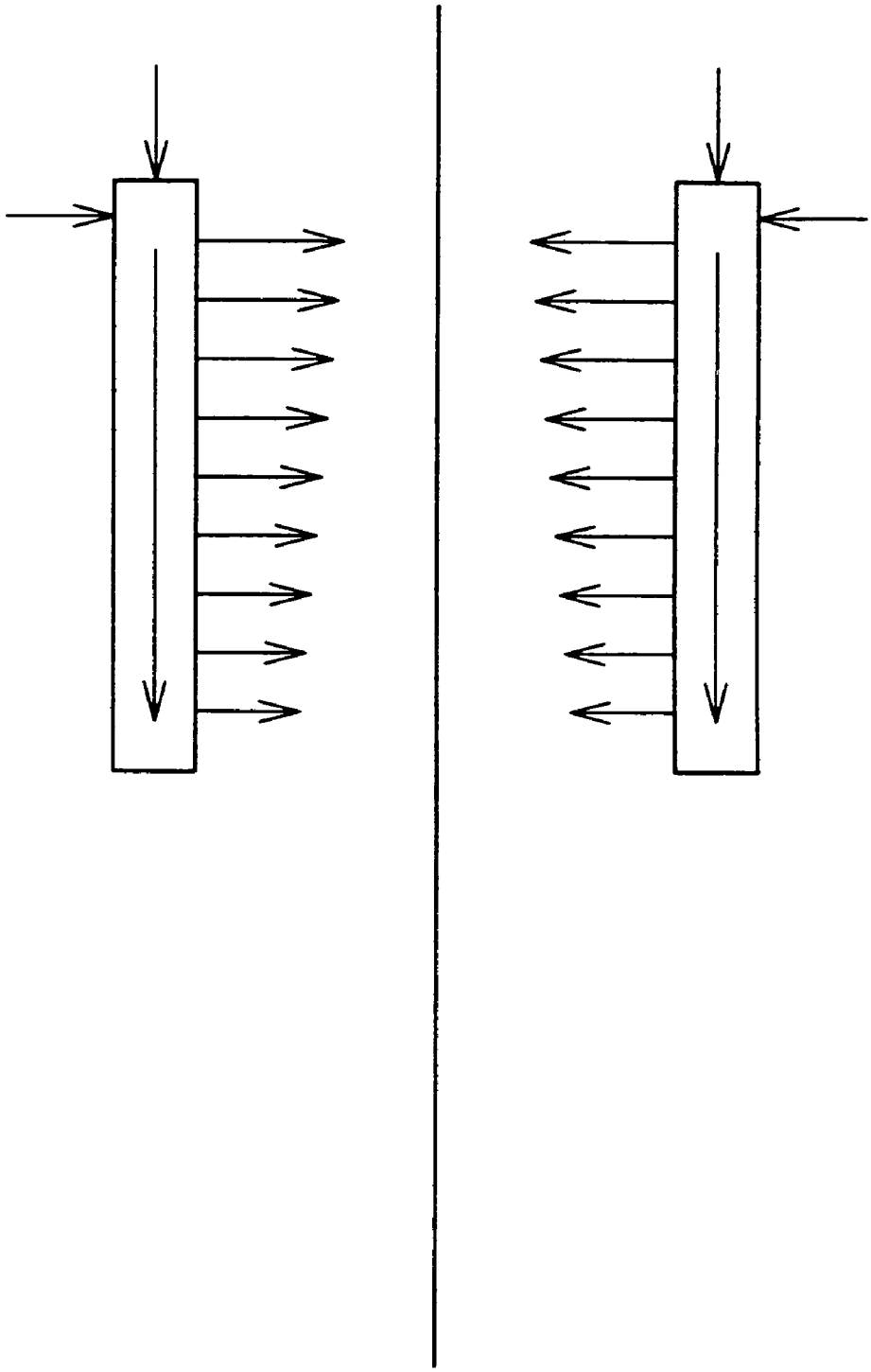
FIG. 14 is a schematic illustration showing an example of windboxes according to the seventh invention of the present invention.

An example of such windboxes (windboxes according to the seventh invention) is shown in FIG. 14. Here, in FIG. 14, the center line between the front faces of the opposing windboxes shows a traveling steel strip and the allow lines between the steel strip and the front faces of the windboxes illustratively show the flows and directions of the cooling gas (the jet gas) blown onto the steel strip through the nozzles on each of the windboxes. The other arrow lines at the ends (the upper portions) of the windboxes illustratively show the state where the cooling gas is introduced into the sides and backs at the ends of the windboxes.

An example of the layout of a continuous annealing furnace is shown in FIG. 1. The continuous annealing furnace is composed of a preheating zone, a heating zone, a soaking zone, a rapid cooling zone, a reheating zone, an overaging zone and a final cooling zone. A gas jet cooling device according to the present invention is incorporated in the rapid cooling zone in the case of the continuous annealing furnace exemplified in FIG. 1.

An $H_2$+$N_2$ mixed gas containing $H_2$ of 5 to 10% in concentration, for example, is fed into the annealing furnace in order to prevent the oxidation of the surface of a steel strip from progressing. In this case, the atmosphere in a cooling chamber is composed of the $H_2$+$N_2$ mixed gas containing $H_2$ of 5 to 10% in concentration.

Figure 2:
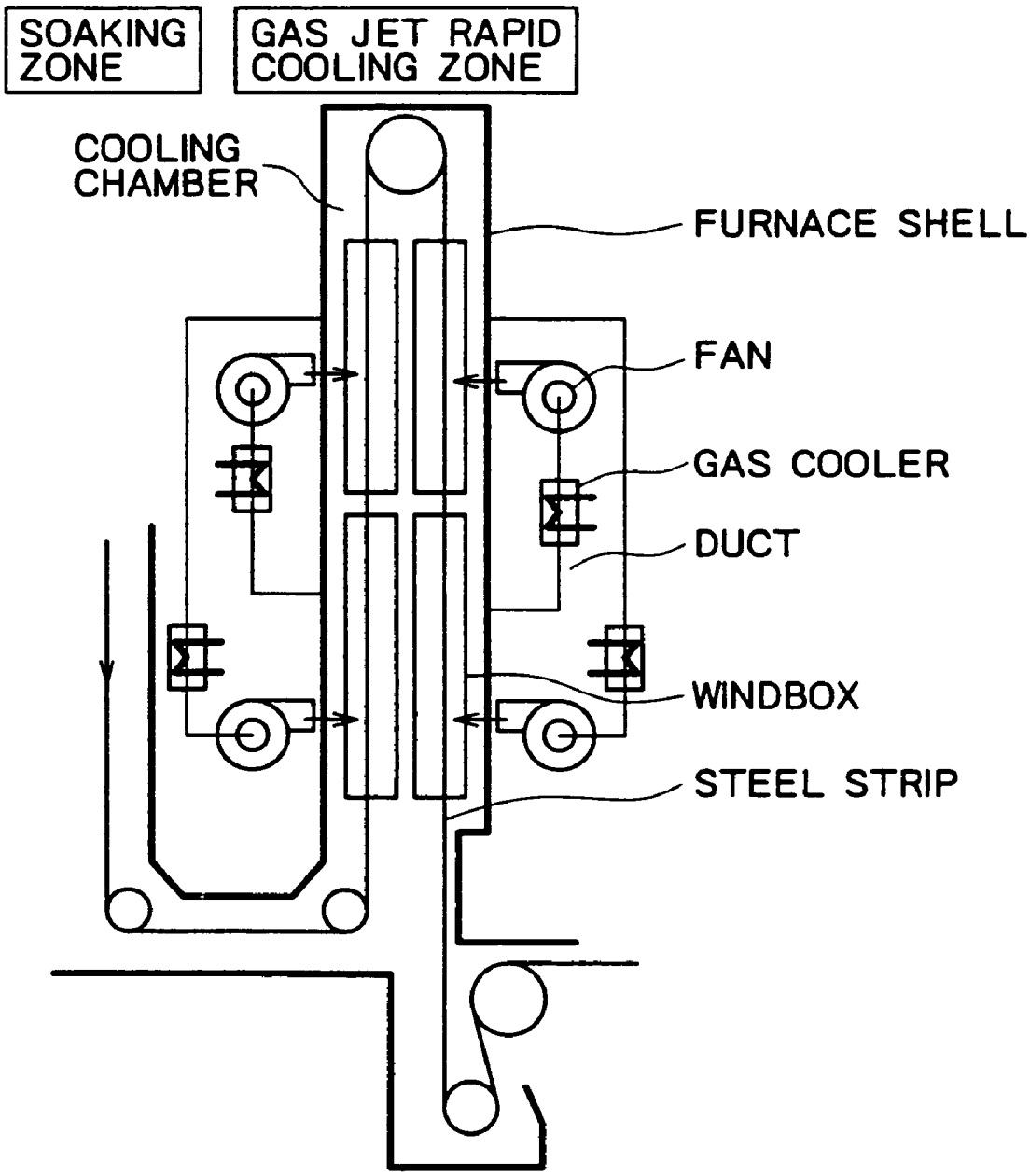
FIG. 2 is a schematic illustration showing an example of a gas jet cooling device according to the present invention.

An example of a gas jet cooling device according to the present invention is shown in FIG. 2. The cooling chamber (the furnace chamber) is shaped with the furnace shell. In the cooling chamber, windboxes equipped with nozzles to blow a cooling gas onto a steel strip are disposed on both the sides of the steel strip in a manner of interposing the steel strip in between. Gas coolers (gas cooling devices) to cool the blown gas introduced from the interior of the cooling chamber through a duct (a suction duct) and fans (circulating fans) to boost the pressure of the gas are disposed and thereby the system to supply the cooled gas again to the windboxes is configured. This system corresponds to an example of "a means of cooling the gas introduced from a cooling chamber and then supplying the cooled gas to windboxes as the cooling gas" in the jet gas cooling device according to the present invention. Here, the composition of the cooling gas is identical with the gas fed into the annealing furnace. That is, in the case where the gas fed into the annealing furnace is an $H_2$+$N_2$ mixed gas containing $H_2$ of 5 to 10% in concentration, the cooling gas is also an $H_2$+$N_2$ mixed gas containing $H_2$ of 5 to 10% in concentration.

Figure 4A:
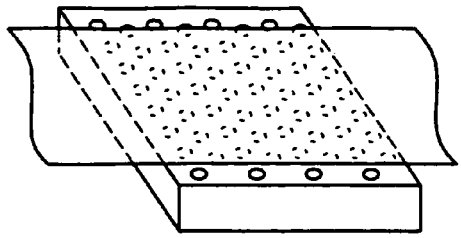
FIG. 4(A) is a perspective view, FIG. 4(B) a side view, FIG. 4(C) a front view, and FIG. 4(D) a top view.
Figure 4B:
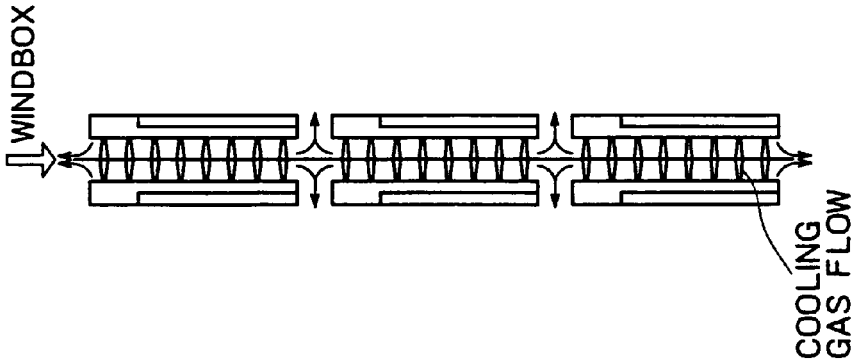
FIG. 4 comprises a group of schematic illustrations showing an example of the shape of a windbox and the allocation of windboxes in the steel strip traveling direction in a gas jet cooling device according to the present invention.
Figure 4C:
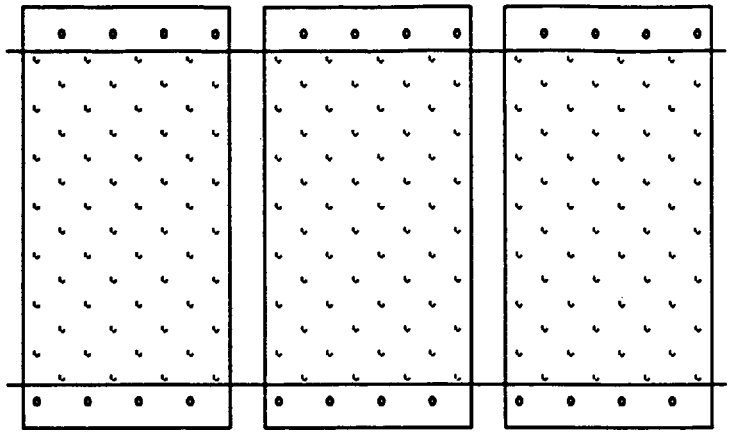
Figure 4D:
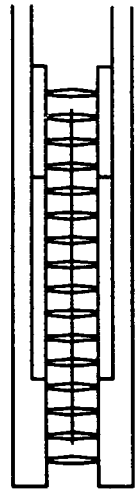

An example of the shape, the allocation in the steel strip traveling direction and others of windboxes in a gas jet cooling device according to the present invention is shown in FIGS. 4(A), 4(B), 4(C) and 4(D). The nozzles on each of the windboxes do not protrude and are composed of a group of round holes disposed on the front face of each windbox, and the holes are allocated so as to form a staggered pattern. The number of the windboxes in the strip traveling direction is three. Here, the FIG. 4(A) is a perspective view of the main part, FIG. 4(B) a side view, FIG. 4(C) a front view, and FIG. 4(D) a top view. In FIG. 4(B), the center line between the front faces of the opposing windboxes shows a traveling steel strip and the lines between the steel strip and the front faces of the windboxes illustratively show the flows of the cooling gas (the jet gas) blown onto the steel strip through the nozzles on each of the windboxes.

In order to configure a cooling system that makes use of forced convective heat transfer by multiple perforation jets, it is necessary to allocate plural nozzle rows in the steel strip traveling direction since the gas flowing along the steel strip after the blow of the jet gas also contributes to the cooling. More specifically, since the gas flowing along the steel strip is evacuated from the front faces of the windboxes immediately after the jet gas has been blown onto the steel strip, the cooling system that makes use of forced convective heat transfer by multiple perforation jets can be configured by allocating not less than two rows of nozzles between the uppermost row and the lowermost row in addition to the uppermost and lowermost rows. For that reason, at least four rows or more are necessary.

Figure 3C:
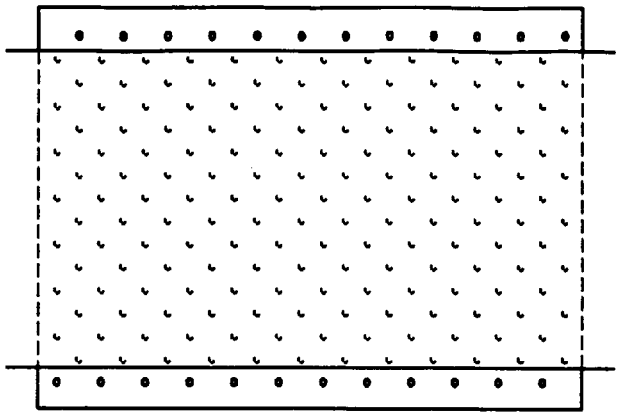
FIG. 3 comprises a group of schematic illustrations showing an example of the shape of a windbox according to the prior art.
FIG. 3(A) is a perspective view, FIG. 3(B) a side view, FIG. 3(C) a front view, and FIG. 3(D) a top view.
Figure 3D:
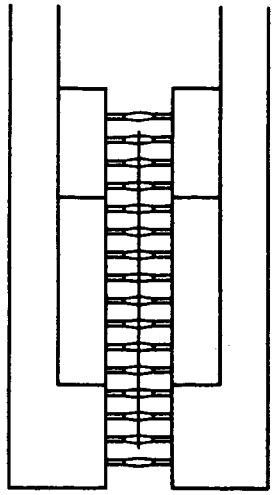
Figure 3B:
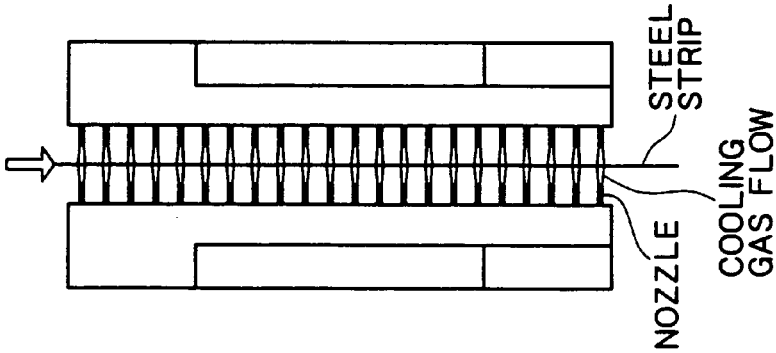
Figure 3A:
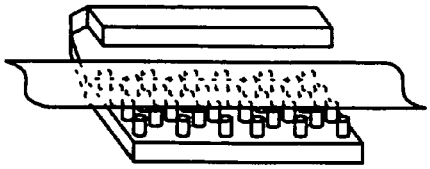

An example of the shape and others of the windboxes in the aforementioned prior art (the gas jet cooling device disclosed in JP-A No. 116724/1987) is shown in FIGS. 3(A), 3(B), 3(C) and 3(D). The FIG. 3(A) is a perspective view of the main part, FIG. 3(B) a side view, FIG. 3(C) a front view, and FIG. 3(D) a top view. In FIG. 3(B), the center line between the front faces of the opposing windboxes shows a traveling steel strip, the cylindrical bodies protruding from the front face of each of the windboxes show nozzles, and the lines between the tips of the nozzles and the steel strip illustratively show the flows of the cooling gas (the jet gas) blown onto the steel strip through the nozzles. In the case of the aforementioned prior art, as shown in FIG. 3, the nozzles protrude and the free space (the free space excluding the space between the steel strip and the tip faces of the nozzles in the furnace) is formed in the furnace. In the case of the aforementioned prior art, since the nozzles protrude at a distance enough to form such an in-furnace free space, the distance between the steel strip and the front faces of the windboxes is long and thereby the size of the cooling chamber has to be increased.

In contrast, in the case of a gas jet cooling device according to the present invention, it is possible to shorten the distance between the steel strip and the front faces of the windboxes and thereby reduce the size of the cooling chamber. This is also obvious from FIG. 4.

Examples according to the present invention and comparative examples are explained hereunder. Note that, the present invention is not limited to the examples, it is possible to properly modify and apply the present invention within the scope conforming to the tenor of the present invention, and those modifications are also included in the scope of technology according to the present invention.

EXAMPLE A

As a continuous annealing furnace, the one shown in FIG. 1 was used. A gas jet cooling device was installed in the rapid cooling zone of the continuous annealing furnace. As the gas jet cooling device, the same one as shown in FIG. 2 was used. As windboxes of the gas jet cooling device, the same ones as shown in FIG. 4 were used (however, the allocation of the nozzle hole group was varied). The nozzles on each of the windboxes did not protrude and were composed of a group of round holes disposed on the front face of each windbox, and the holes were allocated so as to form a staggered pattern. The intervals of the nozzles (the distance between a nozzle and an adjacent nozzle) were 50 mm.

Since the nozzles of each windbox did not protrude as explained above, the distance (h) between the tips of the nozzles on each windbox and a steel strip equaled the distance between the front face of each windbox and the steel strip. The distance h was set at 50 mm. The diameter (d) of the nozzles on each windbox was 10 mm. The distance h was accordingly five times the nozzle diameter d and that satisfied the requirement, which was that the distance h had to be not more than ten times the nozzle diameter d, for a gas jet cooling device according to the present invention. The present example therefore fulfilled the conditions that allowed a steel strip to be cooled rapidly.

The width of each of the windboxes was identical with the steel strip width (W). The width W was set at 1,800 mm. Therefore both the width (W) of the steel strip and the width of each windbox were 1,800 mm. The length (L) of each windbox, namely the length thereof in the steel strip traveling direction, was varied so as to be ⅙×W, ⅓×W, ½×W, ⅔×W, 1/1×W, and others as shown in Table 1. In those cases, included were: the cases where the requirement, which was that the length L of each of windboxes in the steel strip traveling direction had to be not more than two thirds of the width W of a steel strip, for a gas jet cooling device according to the present invention was satisfied; and also the cases where the same was not satisfied. Here, in Table 1, the box length (L) means the length of each windbox, namely the length of each windbox in the steel strip traveling direction. The vertical to horizontal ratio (L/W) meant the ratio of the length L of each windbox to the width W of each windbox and was identical with the ratio of the length L of each windbox in the steel strip traveling direction to the width W of the steel strip.

A plural number of such windboxes were disposed. In other words, the number of the windboxes disposed in the steel strip traveling direction was varied. In this case, the windboxes were disposed so that the ratio (z/h) of the gap (z) between a windbox and an adjacent windbox to the distance between the front face of each windbox and a steel strip, namely the distance (h) between the tips of the nozzles on each windbox and a steel strip, was 2.0. It was configured so that the gas after blown was evacuated toward the back of each windbox through the gaps.

The gas jet cooling device equipped with such windboxes was operated and the capability of cooling a steel strip uniformly in the steel strip width direction and others were investigated. In this case, the flow rate of the cooling gas ejected from the nozzles on each windbox (the flow rate of the cooling gas at the tip of each nozzle) was controlled to be 80 m/sec. An $H_2$+$N_2$ mixed gas containing $H_2$ of 5 to 10% in concentration was fed into the annealing furnace in order to prevent the oxidation of the surface of a steel strip from progressing. The atmosphere in the cooling chamber was composed of the $H_2$+$N_2$ mixed gas containing $H_2$ of 5 to 10% in concentration. This meant that the $H_2$+$N_2$ mixed gas containing $H_2$ of 5 to 10% in concentration was used as the cooling gas.

Figures 5A, 5B, 5C:
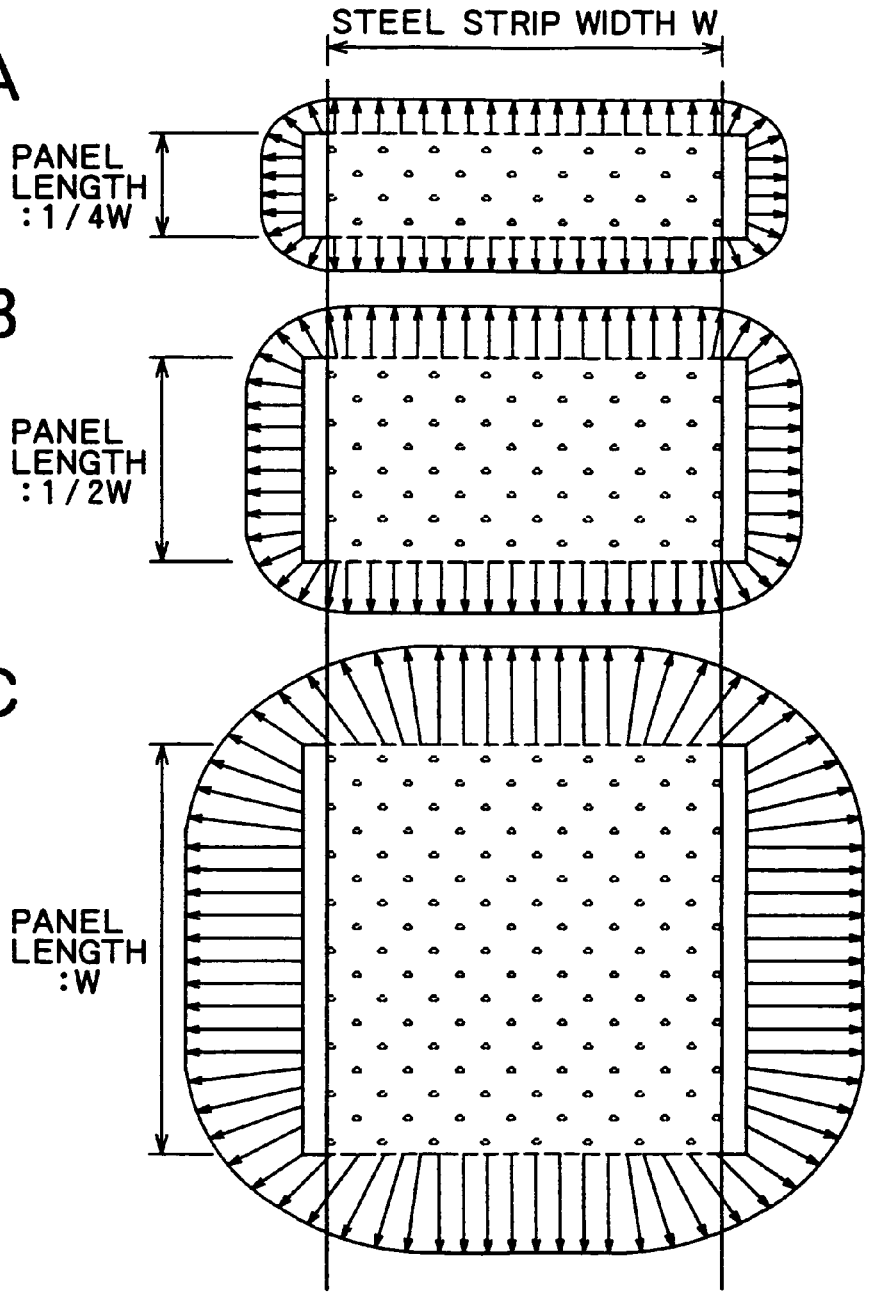
FIG. 5(A) is the gas flow diagram in the case where the length L of a windbox is ¼×W (one fourth of the steel strip width W), FIG. 5(B) the same in the case where the length L of a windbox is ½×W, and FIG. 5(C) the same in the case where the length L of a windbox is ¹⁄₁×W.

The results are explained hereunder. FIG. 5 shows the flow diagram of a gas ejected from the circumference of each windbox (the flow of the cooling gas ejected from each windbox through the nozzles and being blown onto the steel strip (the flow of the cooling gas after blown)). FIG. 5(A) is the gas flow diagram in the case where the length L of a windbox is ¼×W (namely ¼ of the steel strip width W), FIG. 5(B) the same in the case where the length L of a windbox is ½×W, and FIG. 5(C) the same in the case where the length L of a windbox is 1/1×W. As it is understood from FIG. 5, as the windbox length L increases, the gas after ejected flows toward the circumference of the windbox (the circumference of the steel strip portion opposing the full face of the windbox) and converges, and thereby the flow rate increases and the ejected gas flow rate at the edge portion (the edge portion of the steel strip portion opposing the full face of the windbox) also increases. Further the ejected gas flow rate attenuates at the four corners of the edge portion of the windbox.

Figure 6:
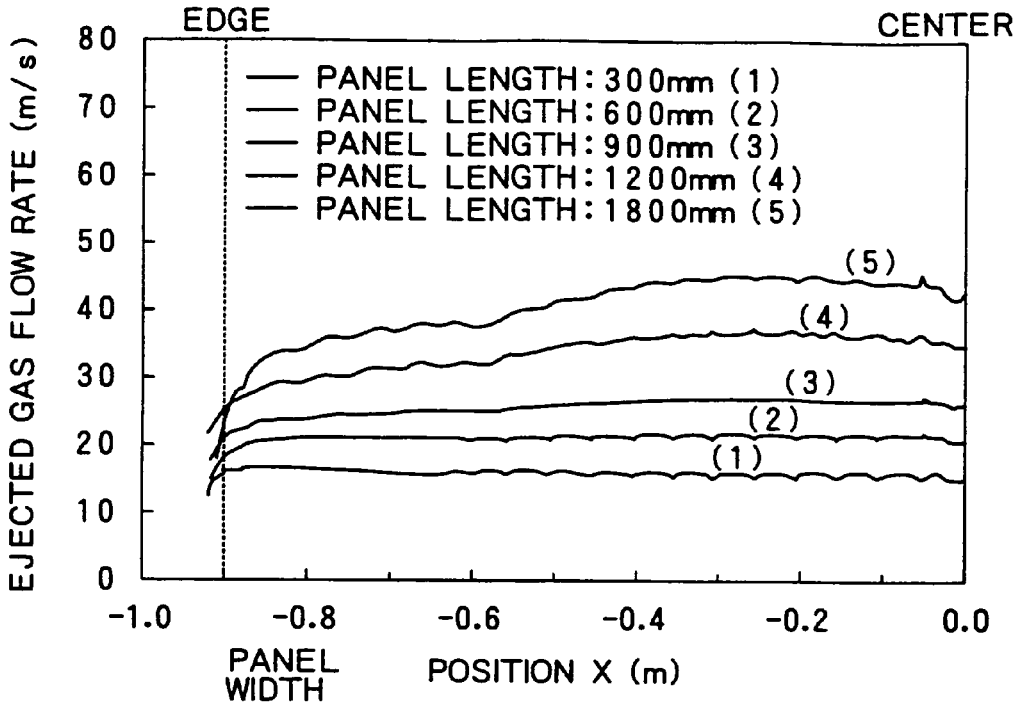
FIG. 6 is a graph showing the distribution of the ejected gas flow rate in the steel strip width direction of each windbox (the relationship between the position and the ejected gas flow rate in the steel strip width direction of each windbox) in the cases of an example according to the present invention and a comparative example.

FIG. 6 shows the distribution of the ejected gas flow rate at the edge portion of each windbox in the steel strip width direction. As it is understood from FIG. 6, as the length L of each windbox (each panel length) increases, the ejected gas flow rate at the edge of each windbox in the steel strip width direction increases and the flow rate difference between the center portion and the edge portion also increases.

Figure 7:
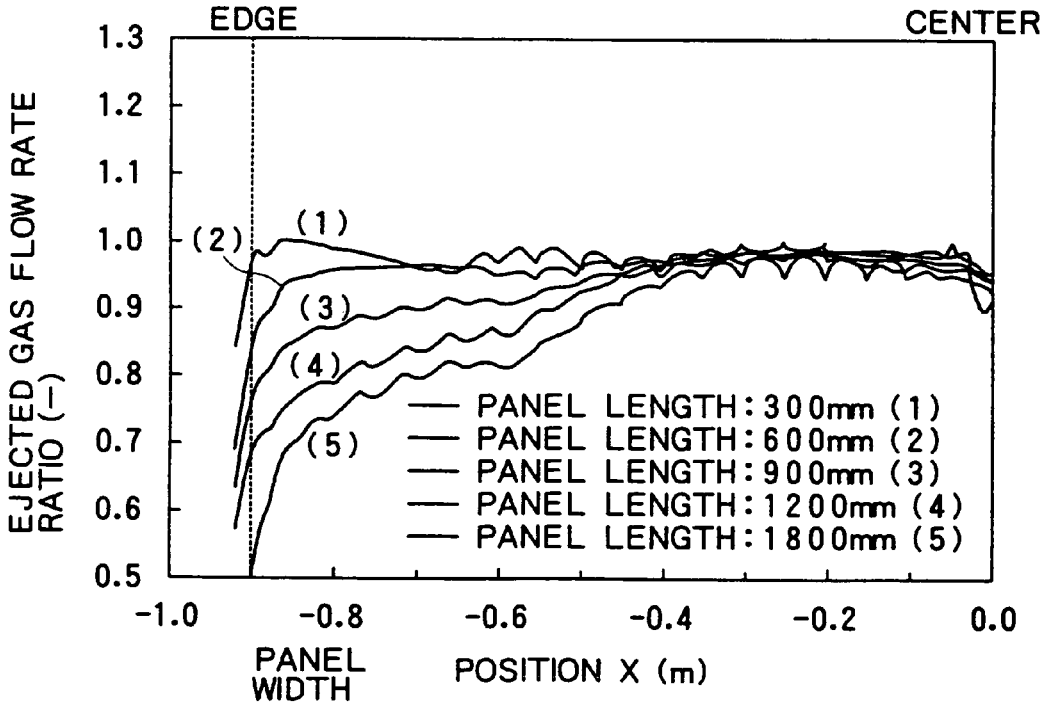
FIG. 7 is a graph showing the distribution of the ejected gas flow rate ratio in the steel strip width direction of each windbox (the relationship between the position and the ejected gas flow rate ratio in the steel strip width direction of each windbox) in the cases of an example according to the present invention and a comparative example.

FIG. 7 shows the distribution of the ejected gas flow rate ratio (the ratio of the ejected gas flow rate at the edge of each windbox in the steel strip width direction to the maximum flow rate in the distribution of the ejected gas flow rate in the steel strip width direction) in the steel strip width direction. As it is understood from FIG. 7, as the length L of each windbox (each panel length) increases, the ejected gas flow rate ratio in the steel strip width direction decreases, the difference of the ejected gas flow rate ratio in the steel strip width direction increases, and thus the deviation of the flow rate increases.

Figure 8:
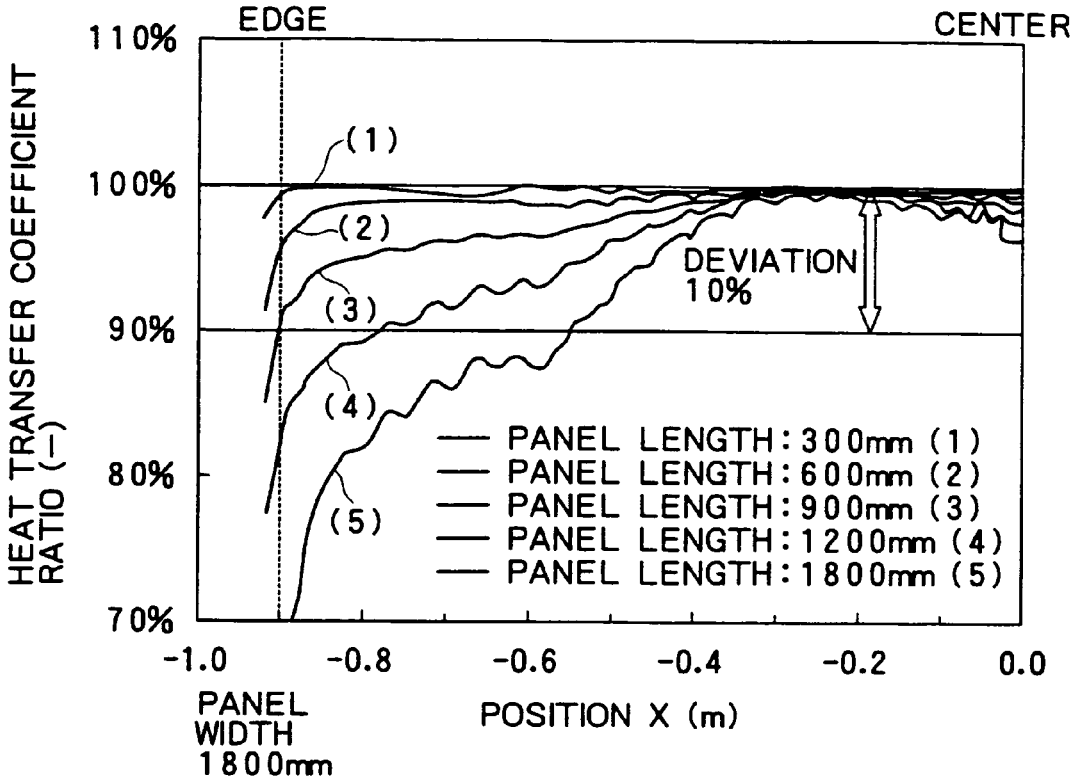
FIG. 8 is a graph showing the distribution of the heat transfer coefficient ratio in the steel strip width direction of each windbox (the relationship between the position and the heat transfer coefficient ratio in the steel strip width direction of each windbox) in the cases of an example according to the present invention and a comparative example.

FIG. 8 shows the cooling capacity ratio (the heat transfer coefficient ratio) of each windbox in the steel strip width direction. As it is understood from FIG. 8, in order to equalize the temperature distribution in the steel strip width direction, it is necessary to control the deviation of the heat transfer coefficient in the steel strip width direction to not more than 10%. When the length L of each windbox (each panel length) increases, the effective width wherein the deviation of the heat transfer coefficient in the steel strip width direction is not more than 10% decreases.

Figure 9:
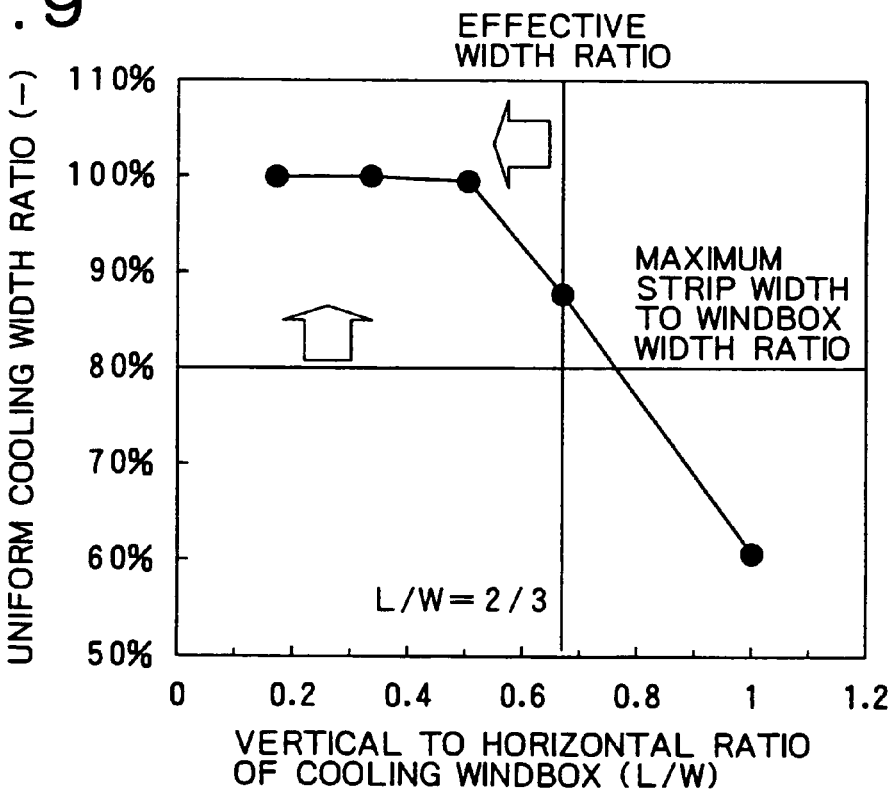
FIG. 9 is a graph showing the relationship between the vertical to horizontal ratio of each cooling windbox and the uniform cooling width ratio.

FIG. 9 shows the relationship between the vertical to horizontal ratio of each windbox and the effective width ratio wherein the deviation of the heat transfer coefficient between the center portion and the edge portion in the steel strip width direction is not more than 10%. The width of a windbox in a continuous annealing furnace is designed so as to be larger than the maximum strip width by about 10 to 20% (the maximum strip width×(1+(0.1 to 0.2))) in consideration of the meandering of a steel strip. Consequently, it has been clarified that it is only necessary to control the vertical to horizontal ratio of each windbox to not more than ⅔×W in order to keep the deviation of the heat transfer coefficient not more than 10% over the steel strip width of not less than 80% of the windbox width.

Figure 10:
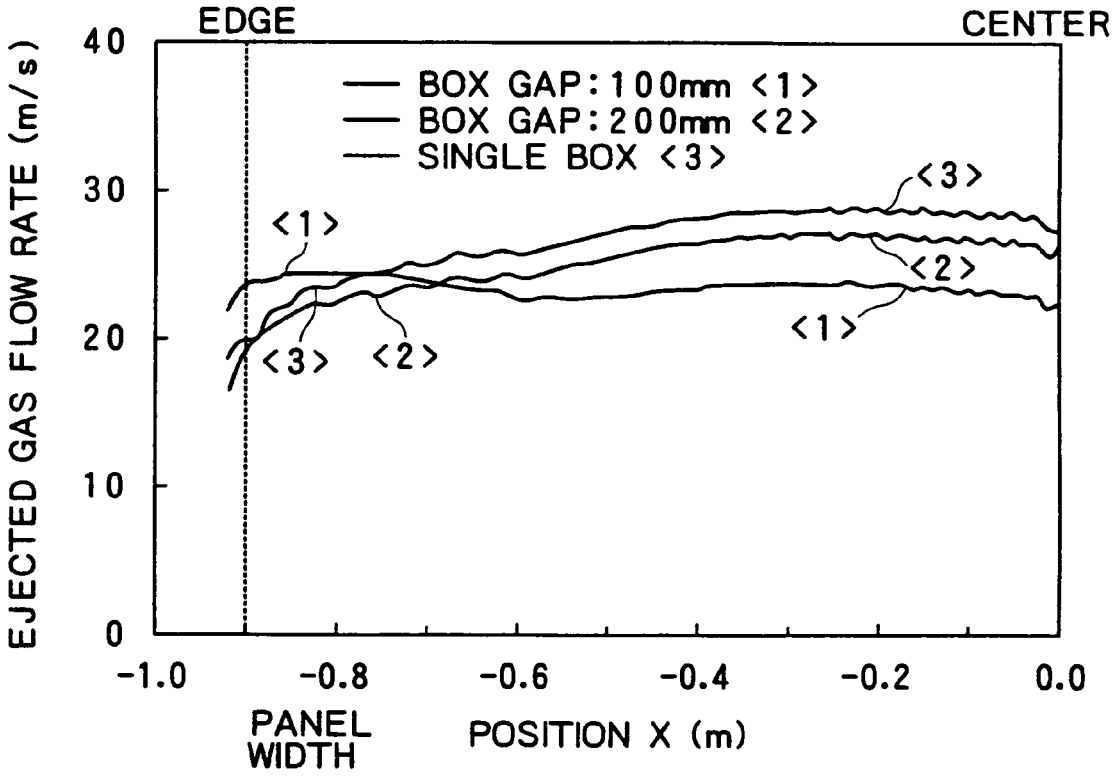
FIG. 10 is a graph showing the distribution of the ejected gas flow rate in the steel strip width direction of each windbox (the relationship between the position and the ejected gas glow rate in the steel strip width direction of each windbox).

When a plural number of windboxes are allocated in the strip traveling direction, it is desirable to allocate the windboxes consecutively and reduce the gap z in order to enhance the cooling capacity. However, when the gap z between windboxes is reduced, the gas after cooling is not evacuated through between windboxes toward the steel strip traveling direction but evacuated toward the windbox width direction. Thereby, the gas after cooling flows toward the steel strip width direction and the deviation of the cooling capacity in the width direction increases. In this light, the influence of the gap z between windboxes was investigated. The results are shown in FIG. 10. That is, FIG. 10 shows the influence of the box gap (the gap z between windboxes) on the distribution of the ejected gas flow rate in the steel strip traveling direction. Here, in the case of FIG. 10, the length L of each windbox is 1,200 mm (⅔×W).

As it is understood from FIG. 10, in the case where the gap z between windboxes is 100 mm, the distribution of the ejected gas flow rate is different from the cases where single windbox is used and the gap z between windboxes is 200 mm, the flow rate lowers locally, and the overall average flow rate also lowers. As a result, the cooling capacity does not lower from the center portion toward the edge portion and there is the possibility of forming a cooled spot locally.

Figure 11:
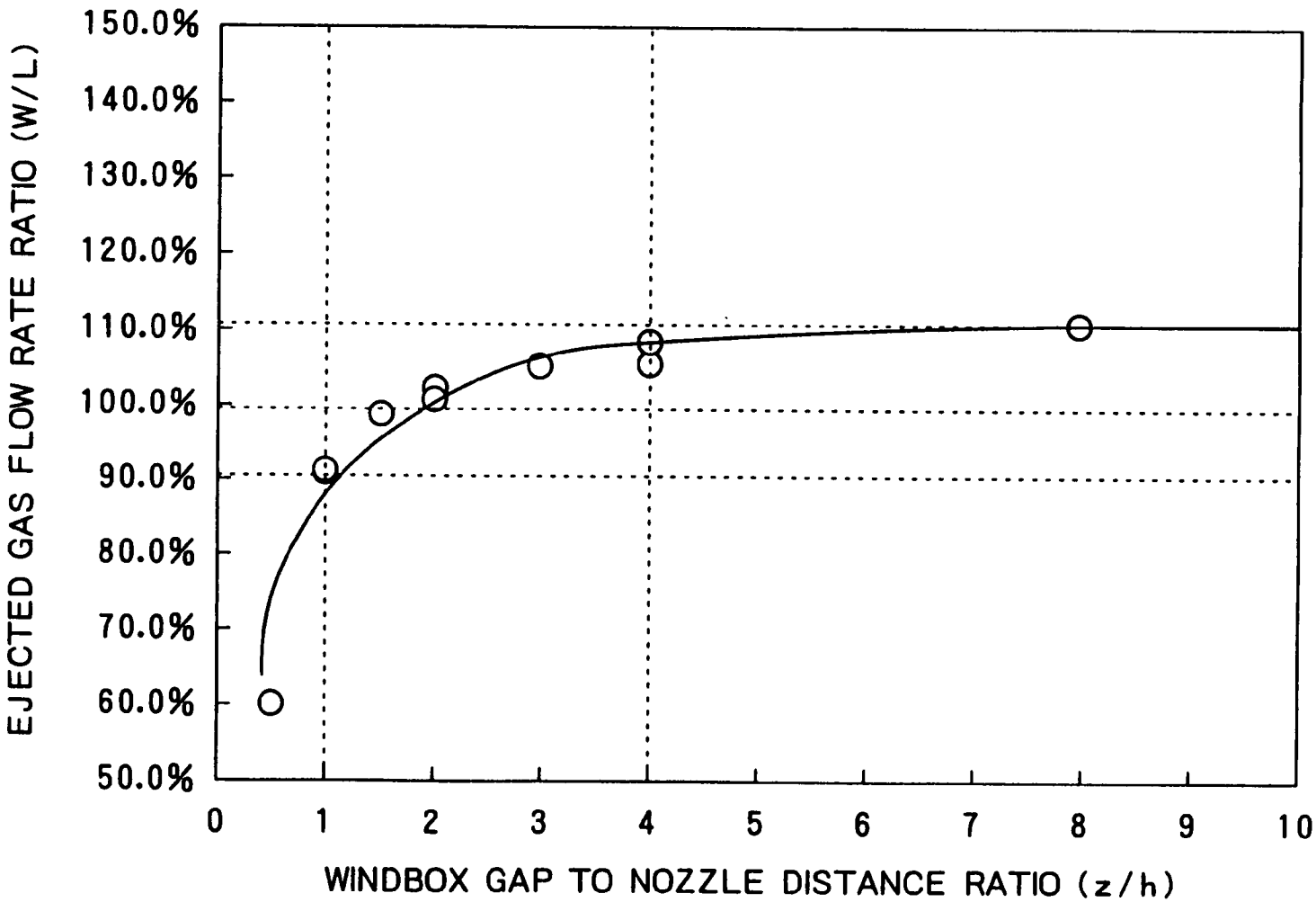
FIG. 11 is a graph showing the relationship between: the ratio (z/h) of the gap (z) between adjacent two windboxes to the distance (h) between a steel strip and nozzle tips; and the ejected gas flow rate ratio.

Then, the relationship between: the ratio (z/h) obtained by dividing the gap z between windboxes by the distance h between the tips of the nozzles on a windbox and a steel strip; and the horizontal to vertical ratio of the average ejected gas flow rate at the edge of a windbox (the ratio of the average ejected gas flow rate at the edge of a windbox in the steel strip width direction to the average ejected gas flow rate at the edge of the windbox in the steel strip traveling direction) was investigated. The results are shown in FIG. 11. As it is understood from FIG. 11, when the ratio z/h is not more than 1.0, the ejected gas flow rate in the steel strip width direction lowers dramatically, the ejected gas flow rate in the steel strip traveling direction increases, and the deviation of the cooling capacity in the steel strip width direction increases accordingly. On the other hand, when the ratio z/h is not less than 2.0, the ejected gas flow rate in the steel strip width direction exceeds the same in the steel strip traveling direction, and, when the ratio z/h is not less than 4.0, the horizontal to vertical ratio of the ejected gas flow rate is constant. Consequently, in the case of such a windbox gap z that the ratio z/h is not less than 4.0, merely the cooling capacity (rapid cooling capacity) lowers. As a result, in order to realize uniform cooling and rapid cooling simultaneously, it is important to secure such a windbox gap z that the ratio z/h is in the range from 1.0 to 4.0.

EXAMPLE B

As a continuous annealing furnace, the one shown in FIG. 1 was used. A gas jet cooling device was installed in the rapid cooling zone of the continuous annealing furnace. As the gas jet cooling device, the same one as shown in FIG. 2 was used. As windboxes of the gas jet cooling device, the same ones as shown in FIG. 4 were used (however, the allocation of the nozzle hole group was varied). The nozzles on each of the windboxes did not protrude and were composed of a group of round holes disposed on the front face of each windbox, and the holes were allocated so as to form a lattice pattern. The intervals of the nozzles (the distance between a nozzle and an adjacent nozzle) were 50 mm.

Since the nozzles of each windbox did not protrude as explained above, the distance (h) between the tips of the nozzles on each windbox and a steel strip equaled the distance between the front face of each windbox and the steel strip. The distance h was set at 50 mm. The diameter (d) of the nozzles on each windbox was 10 mm. The distance h was accordingly five times the nozzle diameter d and that satisfied the requirement, which was that the distance h had to be not more than ten times the nozzle diameter d, for a gas jet cooling device according to the present invention. The present example therefore fulfilled the conditions that allowed a steel strip to be cooled rapidly.

The width of each of the windboxes was identical with the steel strip width (W). The width W was set at 1,800 mm. Both the width (W) of the steel strip and the width of each windbox were therefore set at 1,800 mm. The length (L) of each windbox, namely the length thereof in the steel strip traveling direction, was set at 900 mm, namely $L=\frac{1}{2}\times W$. The length L in this case satisfied the requirement, which was that the length L of each of windboxes in the steel strip traveling direction had to be not more than two thirds of a steel strip width W, for a gas jet cooling device according to the present invention.

A plural number of such windboxes were disposed. The number of the windboxes in the steel strip traveling direction was three. That meant that the total number of windboxes allocated on both the sides of a steel strip was six. In this case, the windboxes were allocated so that the windbox gap z was 100 mm and the ratio z/h was 2.0 (=100 mm/50 mm).

Such windboxes were installed as the windboxes for a gas jet cooling device in the rapid cooling zone of a continuous annealing furnace. Then the continuous annealing started and the gas jet cooling device was operated. The rapid and uniform cooling of a steel strip could be obtained with the gas jet cooling device.

As mentioned above, the distance h between the tips of the nozzles on each windbox and a steel strip equaled the distance between the front face of each windbox and the steel strip, and was 50 mm. The distance between the front face of each windbox and the steel strip (50 mm) was shorter than that in the case of the aforementioned prior art (the gas jet cooling device disclosed in JP-A No. 116724/1987), more specifically, the former was one half or less of the latter.

Therefore the gas jet cooling device stated above makes it possible to cool a steel strip rapidly and uniformly even when the distance between the steel strip and the front face of each windbox is short and the size of a cooling chamber is small in comparison with the case of the aforementioned prior art. In other words, the gas jet cooling device makes it possible to secure the capability of the rapid and uniform cooling of a steel strip, on top of that, to shorten the distance between the steel strip and the front face of each windbox, and thus to reduce the size of a cooling chamber in comparison with the case of the aforementioned prior art.

TABLE 1

| Box length (L) | 300 mm | 600 mm | 900 mm | 1200 mm | 1800 mm |
|---|---|---|---|---|---|
| Vertical to horizontal ratio (L/W) | 1/6 | 1/3 | 1/2 | 2/3 | 1/1 |

The gas jet cooling device for a steel strip in a continuous annealing furnace according to the present invention makes it possible: to cool a steel strip rapidly and uniformly even when the distance between the steel strip and the front face of each windbox is short and the size of a cooling chamber is small; to secure the capability of the rapid and uniform cooling of the steel strip; on top of that, to shorten the distance between the steel strip and the front face of each windbox; and thus to reduce the size of the cooling chamber. As a result, the mass of an insulator per unit cooling length of the cooling chamber decreases, thus the thermal capacity thereof decreases, and thereby the responsiveness (the thermal inertia) of the temperature in the cooling chamber improves. As a result, even when the steel strips the intended mechanical properties of which are different from each other are continuously processed and thus the cooling conditions are different between the preceding steel strip and the succeeding steel strip, the controllability of the intended cooling end temperature of each steel strip improves and moreover the mechanical properties of each product can easily be secured. Further, the construction cost of a cooling chamber can be reduced. In this regard, it can preferably be used as a gas jet cooling device for a steel strip in a continuous annealing furnace.

What is claimed is:

1. A gas jet cooling device, comprising:

a cooling chamber;

windboxes being disposed in said cooling chamber on both the sides of a metal strip to be cooled in a manner of interposing the metal strip in between and moving the metal strip in a traveling direction, said windboxes blowing a cooling gas toward the metal strip to be cooled through nozzles so as to cool the metal strip, wherein width of the area of the windboxes having the nozzles is substantially equal to the width of the metal strip to be cooled; and means for cooling gas introduced from said cooling chamber and then supplying the cooled gas to said windboxes as the cooling gas, wherein the cooling chamber is arranged such that the distance between the tips of the nozzles on each of said windboxes and the metal strip to be cooled is not more than ten times the diameter of said nozzles, and the length of each of said windboxes in the traveling direction of the metal strip to be cooled is not more than two thirds of the width of the area of the windboxes having the nozzles.

2. The gas jet cooling device according to claim 1, wherein said nozzles on each of said windboxes are composed of a group of round or polygonal holes; and said holes are allocated so as to form a lattice pattern or a staggered pattern.

3. The gas jet cooling device according to claim 1, wherein the number of the nozzle rows on each of said windboxes in the traveling direction of the metal strip to be cooled is not less than four, and the number of the nozzle rows thereon in the width direction of the metal strip to be cooled is not less than four.

4. The gas jet cooling device according to claim 1, wherein the number of said windboxes in the traveling direction of the metal strip to be cooled is not less than two, and the ratio of the gap between two adjacent windboxes to said distance between the tips of the nozzles on each of said windboxes and the metal strip to be cooled is in the range from 1.0 to 4.0.

5. The gas jet cooling device according to claim 1, wherein the face, which is opposed to the metal strip to be cooled, of each of said windboxes is flat, and said distance between the tips of the nozzles on each of said windboxes and the metal strip to be cooled stays constant in the width direction of the metal strip to be cooled but changes so as to increase from the upstream toward the downstream in the traveling direction of the metal strip to be cooled.

6. The gas jet cooling device according to claim 1, wherein the face, which is opposed to the metal strip to be cooled, of each of said windboxes has a convex shape in the traveling direction of the metal strip to be cooled and said face forms a curved face, a stepwise face comprising plural planes, or a face comprising two or more inclined planes in the traveling direction of the metal strip to be cooled.

7. The gas jet cooling device according to claim 1, wherein the section of each of said windboxes, said section being parallel with the traveling direction of the metal strip to be cooled and perpendicular to the metal strip to be cooled, has a rectangular shape, wherein the opening of each windbox to supply said cooling gas is disposed on at least one of the side face and the back face of said windbox at the upstream end or the downstream end of said windbox in the traveling direction of the metal strip to be cooled, and wherein the ratio of the sectional area of said rectangular shape to the total of the areas of nozzle openings of said windbox is in the range from 1.0 to 3.0.

8. A gas jet cooling device, comprising:

a cooling chamber;

means for moving a metal strip having a width through the cooling chamber in a traveling direction;

windboxes being disposed in said cooling chamber on both the sides of the metal strip to be cooled in a manner of interposing the metal strip in between the windboxes, said windboxes having an area provided with nozzles directed toward the metal strip for blowing cooling gas to cool the metal strip, wherein width of the area of the windboxes having the nozzles is substantially equal to the width of the metal strip to be cooled; and means for cooling gas introduced from said cooling chamber and then supplying the cooled gas to said windboxes as the cooling gas, wherein the cooling chamber is arranged such that the distance between the tips of the nozzles on each of said windboxes and the metal strip to be cooled is not more than ten times the diameter of said nozzles, and the length of each of said windboxes in the traveling direction of the metal strip to be cooled is not more than two thirds of the width of the area of the windboxes having the nozzles.

9. The gas jet cooling device according to claim 1, wherein the length of each of said windboxes in the traveling direction of the metal strip to be cooled is not more than one half of the width of the area of the windboxes having the nozzles.

10. The gas jet cooling device according to claim 8, wherein the length of each of said windboxes in the traveling direction of the metal strip to be cooled is not more than one half of the width of the area of the windboxes having the nozzles.

11. The gas jet cooling device according to claim 1, wherein the length of each of said windboxes in the traveling direction of the metal strip to be cooled is not more than one third of the width of the area of the windboxes having the nozzles.

12. The gas jet cooling device according to claim 8, wherein the length of each of said windboxes in the traveling direction of the metal strip to be cooled is not more than one third of the width of the area of the windboxes having the nozzles.

* * * * *

UNITED STATES PATENT AND TRADEMARK OFFICE

CERTIFICATE OF CORRECTION

PATENT NO. : 7,381,364 B2
APPLICATION NO. : 11/124293
DATED : June 3, 2008
INVENTOR(S) : Yamashita It is certified that error appears in the above-identified patent and that said Letters Patent is hereby corrected as shown below:

On the title page, Item (73), the Assignee information is incorrect. Item (73) should read:

-- (73) Assignee: Kabushiki Kaisha Kobe Seiko Sho (Kobe Steel, Ltd.), Kobe-shi (JP) --

Signed and Sealed this

Fifth Day of August, 2008

JON W. DUDAS
*Director of the United States Patent and Trademark Office*